US007048059B2

(12) United States Patent
Adams et al.

(10) Patent No.: US 7,048,059 B2
(45) Date of Patent: May 23, 2006

(54) ANNULUS PRESSURE CONTROL SYSTEM FOR SUBSEA WELLS

(75) Inventors: Jeffrey K. Adams, Broken Arrow, OK (US); Scott C. Strattan, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 71 days.

(21) Appl. No.: 10/270,970

(22) Filed: Oct. 15, 2002

(65) Prior Publication Data

US 2004/0069495 A1 Apr. 15, 2004

(51) Int. Cl.
*E21B 29/12* (2006.01)

(52) U.S. Cl. ..... 166/348; 166/344; 166/227; 166/187

(58) Field of Classification Search ..... 166/368, 166/348, 363, 364, 187, 227, 344, 345
See application file for complete search history.

(56) References Cited

U.S. PATENT DOCUMENTS 4,130,161 A 12/1978 Jones
4,589,484 A * 5/1986 Doherty et al. ..... 166/179
5,425,424 A * 6/1995 Reinhardt et al. ..... 166/291
5,785,131 A 7/1998 Gray
5,927,405 A 7/1999 Monjure et al.
6,213,217 B1 * 4/2001 Wilson et al. ..... 166/387
6,293,346 B1 9/2001 Patel
6,305,477 B1 * 10/2001 Carisella et al. ..... 166/387
6,651,747 B1 * 11/2003 Chen et al. ..... 166/382
2002/0117305 A1 8/2002 Calder et al.

FOREIGN PATENT DOCUMENTS

WO WO 02/079659 A2 10/2002

OTHER PUBLICATIONS

Richard F. Vargo, et al., "Practical and Successful Prevention of Annular Pressure Buildup on the Marlin Project," SPE No. 77473, 1-10, Sep. 29, 2002.

* cited by examiner

*Primary Examiner*—Thomas B. Will
*Assistant Examiner*—Thomas A Beach
(74) *Attorney, Agent, or Firm*—Steve Rosenblatt

(57) ABSTRACT

The annulus pressure is controlled by displacing incompressible fluid with compressible fluid in the annulus. The displaced fluid is filtered to avoid clogging small lines. The presence of compressible fluid minimizes the thermal effect of warm fluid in the production tubing on annulus pressure. As a result, thinner wall casing can be used, for considerable savings in material and installation cost.

9 Claims, 4 Drawing Sheets

ANNULUS PRESSURE CONTROL SYSTEM FOR SUBSEA WELLS

FIELD OF THE INVENTION

The field of this invention is a pressure control system particularly useful in controlling annulus pressure in subsea wells.

BACKGROUND OF THE INVENTION

In subsea applications, the various casing strings are hung on a hanger in a concentric manner and in descending size order. The annular space between casing runs and the central production tubing is referred to as the A annulus. When production begins, thermal effects act on the fluid in the A annulus to raise its pressure. This occurs because by the nature of how subsea completions take place, the A annulus is full of seawater or/and well fluids, all of which are incompressible. When the production tubing heats up during production, the fluid in the A annulus is expanded. As a result, the casing has had to be sized to contain this pressure increase caused by warming an A annulus full of incompressible fluid. The need to contain the pressures encountered due to this heating effect causes additional expense for heavier walled casing and generally lengthens the time required to run the heavier casing into the well.

The present invention controls pressure buildup in the A annulus by replacing some of the incompressible fluid with compressible gas. It also provides filtration for the fluid displaced from the A annulus under the pressure of the compressible fluid which displaces it. These and other advantages of the present invention will be more apparent to those skilled in the arts from a review of the description of the preferred embodiment and the claims, which appear below.

SUMMARY OF THE INVENTION

The annulus pressure is controlled by displacing incompressible fluid with compressible fluid in the annulus. The displaced fluid is filtered to avoid clogging small lines. The presence of compressible fluid minimizes the thermal effect of warm fluid in the production tubing on annulus pressure. As a result, thinner wall casing can be used, for considerable savings in material and installation cost.

DETAILED DESCRIPTION OF THE PREFERRED EMBODIMENT

Figure 1:
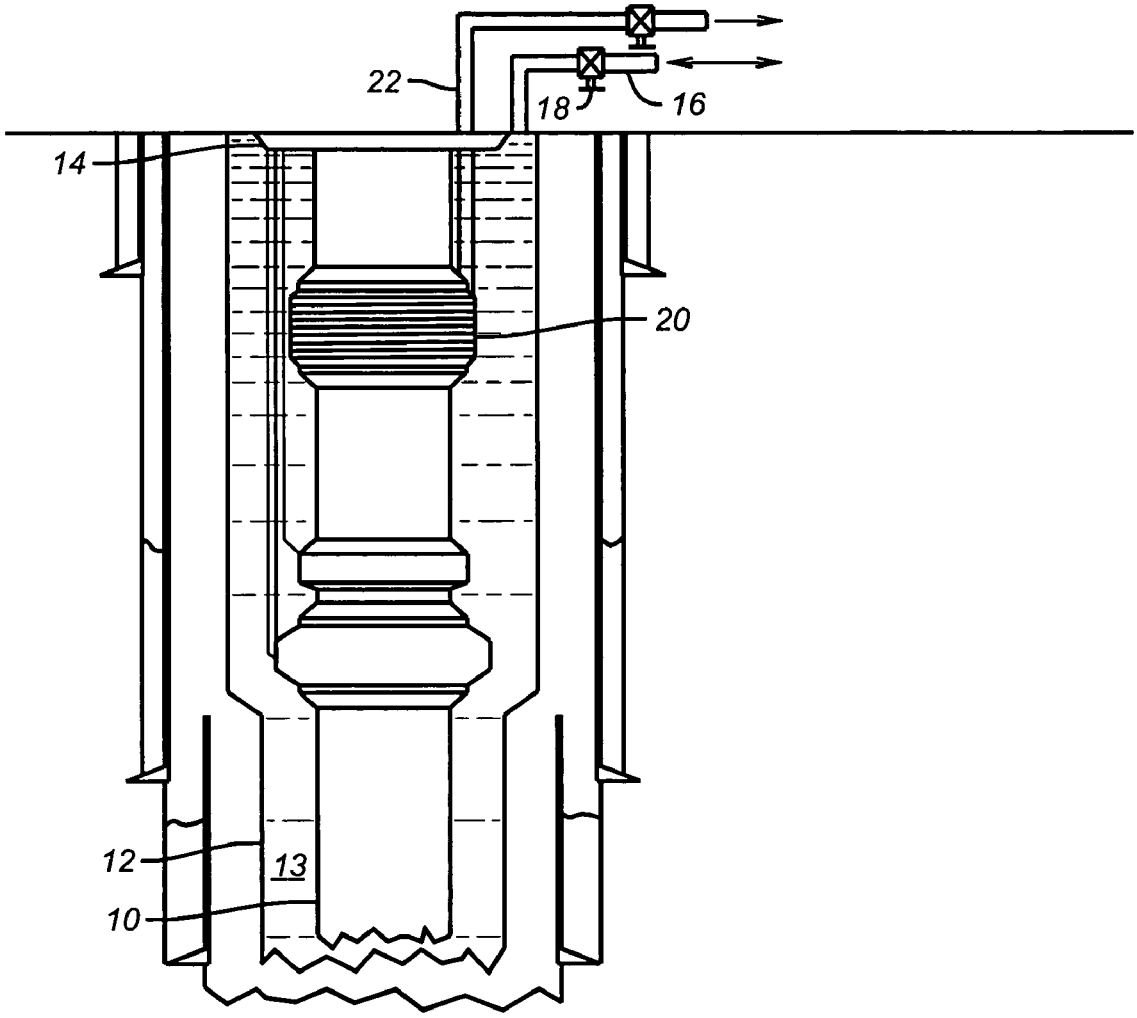
FIG. 1 is a schematic view of the control system prior to fluid displacement.

FIG. 1 shows production tubing 10 surrounded by casing 12 defining the A annulus 13 in between. Hanger 14 supports casing 12 in a known manner. The Christmas tree is omitted but it is a known design that also supports the hanger 14. Access into the annulus 13 is through line 16 by operating valve 18. A pressurized gas source, not shown, can be connected to line 16 and valve 18 opened to allow displacement of incompressible fluid in annulus 13 through screen 20 and through line 22 and valve 24 to a proper location for disposition. Since line 22 is normally a small diameter, normally ½ or ¾ inches in diameter, screen 20 insures that line 22 does not plug with solids during the displacement procedure, shown in FIG. 2.

Figure 2:
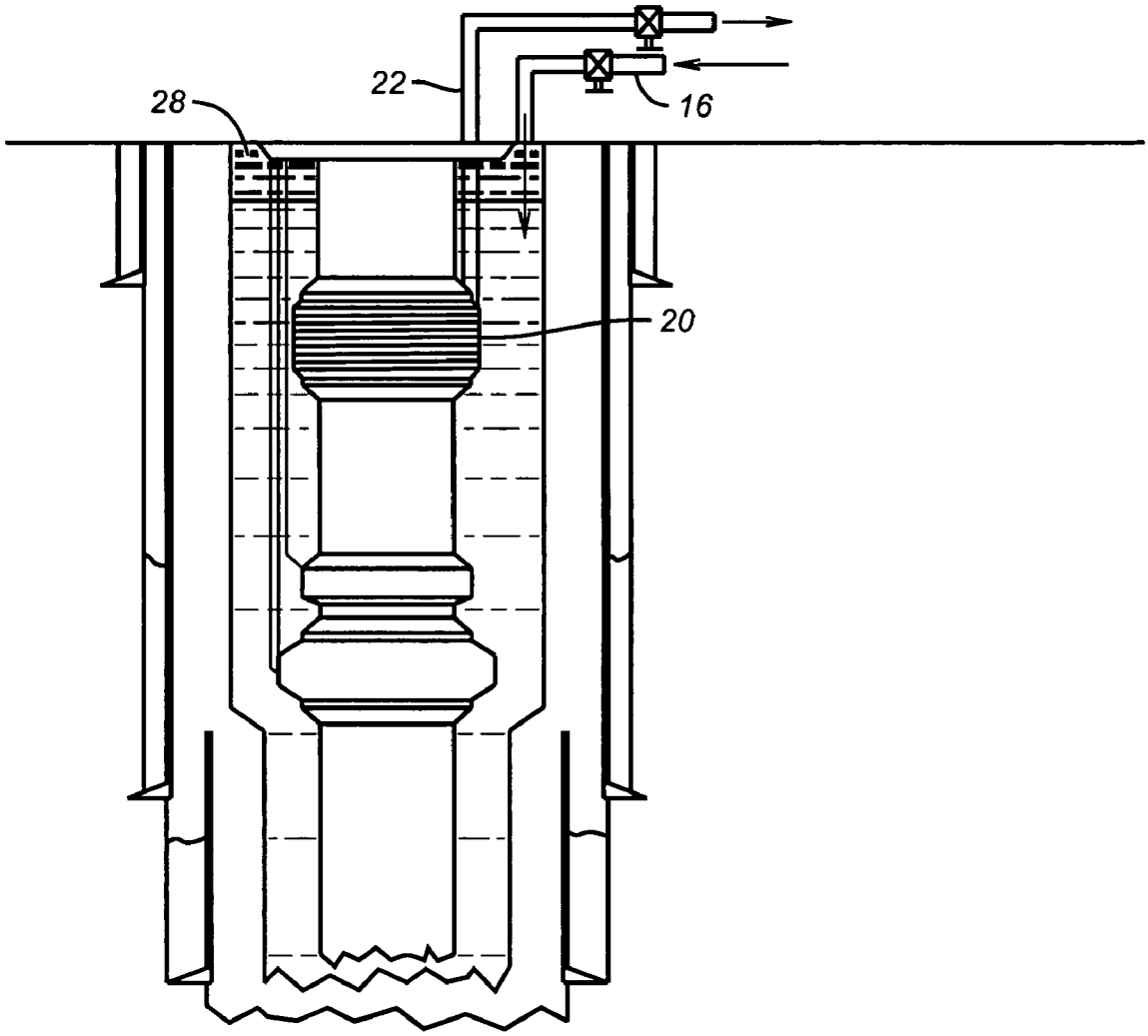
FIG. 2 is the view of FIG. 1 showing fluid being displaced.
Figure 3:
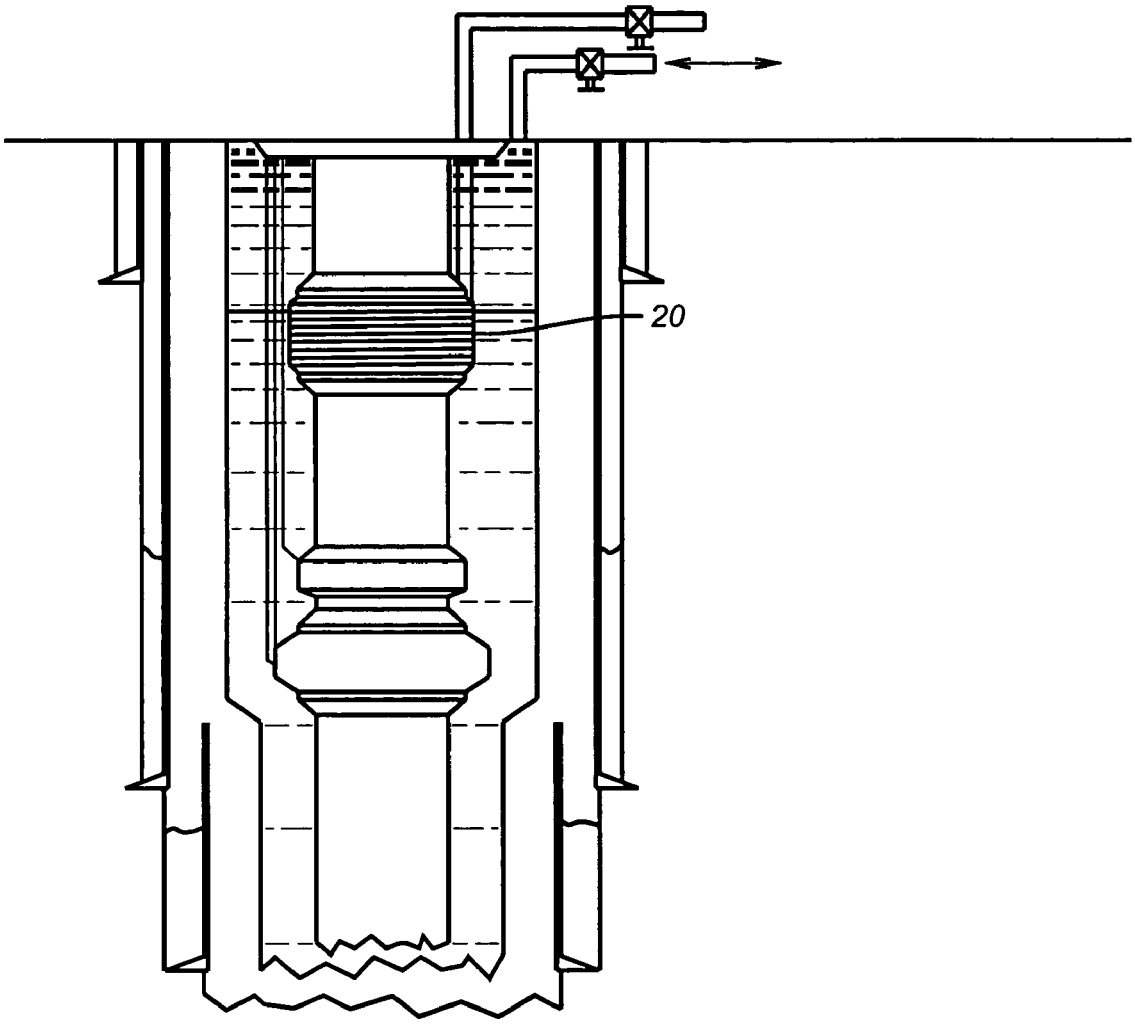
FIG. 3 is the view of FIG. 2 showing the system set for production.
Figure 4:
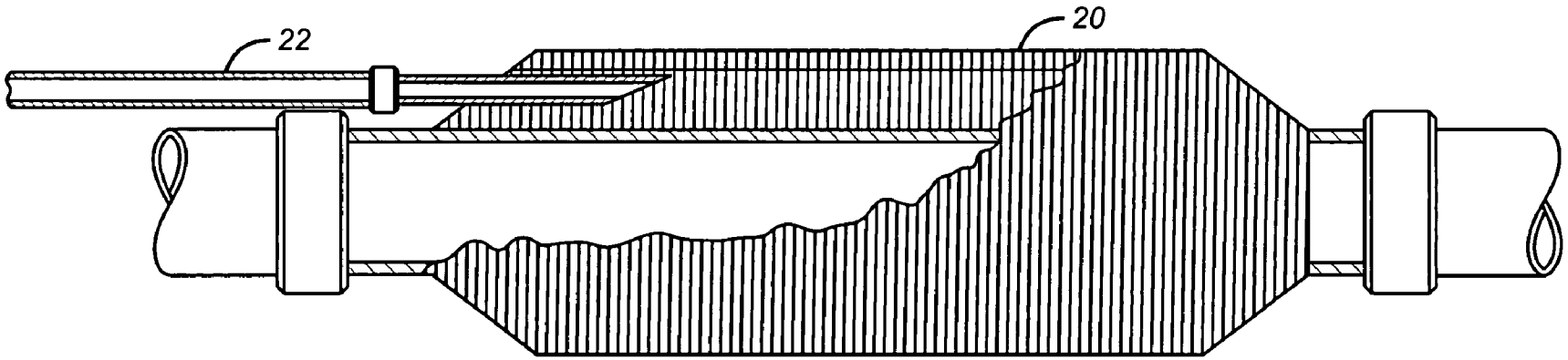
FIG. 4 is a detailed view of the screening of displaced fluid from the annulus.

FIG. 2 illustrates the application of gas pressure into line 16 represented by arrow 26. As a result, a pocket of compressible fluid 28, preferably nitrogen, has formed near the top of annulus 13. At the same time, some compressible fluid has been displaced through screen 20 and out of annulus 13 through line 22. FIG. 3 illustrates full displacement of incompressible fluid down to screen 20. Screen 20 can be positioned at different depths depending on how much incompressible fluid is to be displaced from annulus 13. The screen 20 can be of any known design although a wire wrap design using 12 to 14 gauge, 825 material is preferred. Line 22 can be run through the Christmas tree in a known manner but is shown schematically in the Figures for simplification reasons. Screen 20 also prevents plugging of check valves that are used to prevent release of annulus pressure to the sea floor when the Christmas tree is disconnected. These check valves, not shown, are in the flow path in line 22.

While the concept is particularly applicable in subsea applications, it can be used in other applications where thermal loads cause incompressible fluid pressure buildup in a confined space and removal and replacement of some of the incompressible fluid with a gas acts to limit pressure buildup. This, in turn, allows the enclosing structure to be built with thinner components, saving time and great expense.

The foregoing disclosure and description of the invention are illustrative and explanatory thereof, and various changes in the size, shape and materials, as well as in the details of the illustrated construction, may be made without departing from the spirit of the invention.

We claim:

1. A pressure control method for a downhole annular space in a subsea well, comprising:

displacing incompressible fluid from the annular space with compressible fluid;

filtering the displaced incompressible fluid on its way out of the annular space.

2. The method of claim 1, comprising:

performing filtering with a screen, using the mounted depth of said screen to control how much incompressible fluid is displaced from the annular space.

3. The method of claim 2, comprising:

using a wire wrap screen for said filtering.

4. The method of claim 1, comprising:

protecting check valves in the outlet path from the annular space from solids in the non-compressible fluid being displaced.

5. A pressure control method for a downhole annular space in a subsea well, comprising:

displacing incompressible fluid from the annular space with compressible fluid;

applying a thermal load into the annular space;

allowing said compressible fluid to be compressed to compensate for said thermal load;

reducing the maximum operating pressure in the annular space by the presence of said compressible fluid; and using thinner casing than otherwise would have been used in the absence of said compressible fluid in the annular space.

6. The method of claim 5, comprising:

filtering the displaced incompressible fluid on its way out of the annular space.

7. The method of claim 6, comprising:

performing said filtering with a screen, using the mounted depth of said screen to control how much incompressible fluid is displaced from the annular space.

8. The method of claim 7, comprising:

protecting check valves in the outlet path from the annular space from solids in the non-compressible fluid being displaced.

9. The method of claim 8, comprising:

producing the well through production tubing, which defines, in part, said annular space;

creating said thermal load from the temperature of fluids produced in said production tubing.

* * * * *